US008011699B2

(12) United States Patent
Lane

(10) Patent No.: US 8,011,699 B2
(45) Date of Patent: Sep. 6, 2011

(54) CABLE ACTUATED LATCH SYSTEM

(76) Inventor: Christopher M. Lane, New Hampton, IA (US)

( * ) Notice: Subject to any disclaimer, the term of this patent is extended or adjusted under 35 U.S.C. 154(b) by 865 days.

(21) Appl. No.: 11/906,966

(22) Filed: Oct. 4, 2007

(65) Prior Publication Data

US 2009/0091140 A1 Apr. 9, 2009

(51) Int. Cl.
*E05C 9/12* (2006.01)

(52) U.S. Cl. ..... 292/56; 292/336.3

(58) Field of Classification Search ..... 292/56, 292/336.3, DIG. 64, 123, 97, 48, 26, 223, 292/221

See application file for complete search history.

(56) References Cited

U.S. PATENT DOCUMENTS

| | | | | |
|---|---|---|---|---|
| 6,092,845 | A | 7/2000 | Koenig | |
| 6,361,091 | B1 | 3/2002 | Weschler | |
| 6,419,284 | B1 * | 7/2002 | Kutschat | 292/56 |
| 6,715,806 | B2 * | 4/2004 | Arlt et al. | 292/201 |
| 7,198,308 | B2 * | 4/2007 | Lane et al. | 292/336.3 |
| 7,309,087 | B2 * | 12/2007 | Lane et al. | 292/216 |
| 2005/0166701 | A1 | 8/2005 | Mossler | |
| 2005/0212307 | A1 * | 9/2005 | Lane et al. | 292/336.3 |

FOREIGN PATENT DOCUMENTS

| | | |
|---|---|---|
| DE | 19808375 A1 | 2/1998 |
| GB | 2330193 | 4/1999 |
| GB | 2 412 942 A | 10/2005 |

OTHER PUBLICATIONS

Tri/Mark Corp. Catalog pp. 020-0900 Remote Inside Release.
Tri/Mark Corp. Catalog pp. 050-0100 Two-Rotor Latch.
Tri/Mark Corp. Catalog pp. 050-0106 Two-rotor Latch With Direct Pull Actuation and Remote Inside Release.
DLP Catalog pp. on 61.5201.xxxx Cabdoor Latch.
West Alloy Limited web page on 8200 Anti-burst interior latch.
West Alloy Limited web page on 7720 Anti Burst Interior Latch.

* cited by examiner

*Primary Examiner* — Thomas A Beach
*Assistant Examiner* — Mark Williams
(74) *Attorney, Agent, or Firm* — Wood, Phillips, Katz, Clark & Mortimer

(57) ABSTRACT

An operating mechanism for a movable closure element to releasably engage a strike assembly on a frame support and thereby releasably maintain the movable closure element in a predetermined position relative to the frame support. The operating mechanism has a base with a wall extending around a first axis and defining an elongate tubular passageway. The operating mechanism includes a latch system having: (a) a latched state; and (b) a released state. An actuating system on the base is changeable from a first state into a second state to thereby change the latch system from the latched state into the released state. The actuating system has an elongate flexible cable with a length residing at least partially within the passageway and made up of an elongate sheath and a movable core. An actuating system has an actuating assembly for the elongate flexible cable that is mounted to the wall. The wall is configured so that the cable cannot be extended in a straight line through the passageway between first and second connecting locations.

22 Claims, 12 Drawing Sheets

STRIKE ELEMENT 20
54
16
126
128
216
124
120
112
198
46
194
196
112
122
114
116
130
110
58
100
76
66
68
118
62
102
56
96
72
98
104
94
74
70
64
60
18
210
212
196
224
38
206
214
194
6
142
208
30
144
24
218
220
170
146
28
136
132
162
164
44
36
134
40
140
138
134
262
260
258
6
266
26
268
264
272

CABLE ACTUATED LATCH SYSTEM

BACKGROUND OF THE INVENTION

1. Field of the Invention

This invention relates to operating mechanisms as used to releasably maintain movable elements, such as closure elements, in a predetermined position and, more particularly, to an operating mechanism that is actuated through the use of a cable.

2. Background Art

Operating mechanisms incorporating latch systems are used in a multitude of different environments, for both static and dynamic applications. Commonly, the latch system is incorporated into a movable element, such as a closure element, having closed and open states. Through the latch system, the closure element is releasably maintained in the closed position. The latch system is actuatable to change the state thereof, thereby permitting the closure element to be moved from the closed position into the open position therefor.

One form of such an operating mechanism is shown in U.S. Pat. No. 7,198,308, which is commonly owned herewith. The operating mechanism therein utilizes a tubular component that functions both to support the system operating components and provide a graspable length through which the user can reposition the associated closure element.

The tubular component shown in U.S. Pat. No. 7,198,308 has a straight length bounding a passageway within which an operating rod is operatively positioned. The rod translates in a line substantially parallel to the lengthwise central axis of the tubular component, as an incident of which the state of the latch system is changed.

With such a straight, tubular component, it is also feasible to use a flexible cable that is translated to impart operating forces through which the state of the latch system is changed.

In certain applications, the nature of the closure element and the surrounding environment, and/or specific performance requirements may dictate that the elongate "handle" have other than the straight tubular shape depicted in U.S. Pat. No. 7,198,308. Depending upon the diameter of the tubular component, a certain degree of deviation from "straight" for the shape of the tubular component may be permitted while still maintaining the basic configuration of components shown in the above patent. However, at some level of deviation from straight, the system will not be operable using a single, straight rod.

If the use of a rod is desired, transition linkages may be required to transmit operating forces with such a non-straight tubular component. This may not be practical or, even if it is, such a construction may complicate the design and increase attendant costs to the point that such a design is not feasible on a commercial level. Such a design may require the use of multiple, joined, tubular components to produce the desired overall shape of the "handle". Aside form complicating the design, and potentially increasing its costs, such an arrangement may compromise the structural integrity of the mechanism and, in any event, will eliminate the preferred single piece construction which generally minimizes joints at locations at which moisture and other foreign matter may migrate to within the passageway and potentially degrade components and, in a worst case, interfere with their operation.

Systems incorporating a flexible cable have more flexibility in terms of accommodating non-straight handle shapes and permitting selection of different orientations of the tubular component relative to the latch system. Flexible cables are also desirable from the standpoint that they may avoid rattling, that is common to the use of operating rods, and generally cause less inertial effect in use than do operating rods. Depending upon the degree of deviation of the tubular component from straight, the manufacturer may choose different design options. If the deviation is not significant, the operating components may be integrated substantially the same as they would be with the straight configuration. At some point, the mechanism loses efficiency as forces are applied to and by the cable. That is, if the ends of the cable are skewed from their optimal force application lines, the applied forces to and from the ends of the cable core become only a component of the tension applied to the cable. At some point, the mechanism may be difficult to operate and prone to jamming.

Alternatively, provision must be made to fix the cable sheath so that the cable core length, at each end where connection is made, is properly aligned to exert the maximum operating force on its associated component. Cables are commonly anchored using connectors employing separate fasteners, such as screws or bolts, at each connector location. Aside from the inconvenience of having to stock and manipulate the separate fasteners, these types of fasteners generally allow the orientation of the cable sheath ends to be varied. Thus, even if one were to use such an arrangement, it is possible, depending upon the control of the manufacturing process, either in a facility or in the field, operation of the overall system may vary significantly from one to the next. Thus, aside from the inconvenience associated with manufacture and the potential increase in cost, there is a question of quality control.

The industry continues to seek out practical designs for tubular components that can be configured to provide greater versatility.

SUMMARY OF THE INVENTION

An operating mechanism is provided for a movable closure element to releasably engage a strike assembly on a frame support and thereby releasably maintain a movable closure element, on which the operating mechanism is mounted, in a predetermined position relative to the frame support. The operating mechanism has a base with a wall extending around a first axis and defining an elongate tubular passageway. The operating mechanism includes a latch system having: (a) a latched state in which the latch system engages a strike element on the strike assembly so as to maintain a movable closure element, on which the operating mechanism is mounted, in the predetermined position; and (b) a released state wherein the latch system can be disengaged from a strike element so as to allow a movable closure element, on which the operating mechanism is mounted, to be moved from the predetermined position. The operating mechanism further includes an actuating system on the base and changeable from a first state into a second state to thereby change the latch system from the latched state into the released state. The actuating system has an elongate flexible cable with a length residing at least partially within the passageway and made up of an elongate sheath and a core that is movable guidingly lengthwise relative to the sheath. The cable core has first and second operating portions spaced lengthwise of the cable. The actuating system further includes an actuating assembly for the elongate flexible cable that is mounted to the wall with the actuating assembly in operative engagement with the base. The first operating portion of the cable core engages the actuating assembly at a first location and the second operating portion of the cable core engages the latch system at a second location. The wall is configured so that the cable cannot be extended in a straight line through the passageway between the first and second locations. The cable core is movable relative to the sheath as the actuating system is changed from the first state into the second state to thereby cause the cable core to change the latch system from the latched state into the released state.

In one form, the sheath has spaced ends and one of the spaced ends is fixed relative to the base in a predetermined operating orientation.

In one form, the actuating assembly has a frame that is mounted to the wall with the actuating assembly in operative engagement with the base and an actuating element that is movable relative to the frame between a normal position and an actuated position, to thereby cause the cable core to move and thereby change the latch system from the latched state into the released state. The one spaced end of the sheath is fixed to the frame in the predetermined operating orientation.

In one form, there are cooperating components on the one spaced end of the sheath and the frame that cooperate to allow the one spaced end of the sheath to be press fit and frictionally maintained in the predetermined operating orientation.

In one form, there is an edge on the frame that grippingly engages a surface on the one end of the sheath with the one end of the sheath in the predetermined operating orientation.

In one form, the edge is defined on a wall on the frame and there are first and second shoulders on the one end of the sheath that face towards each other and between which the frame wall captively resides to at least one of: (a) confine relative shifting of the one end of the sheath and frame wall lengthwise relative to the cable; and (b) maintain the predetermined operating orientation for the one end of the sheath.

In one form, the frame wall has an opening that is fully surrounded by the frame wall. The opening has a larger effective diameter portion and a smaller effective diameter portion. The smaller effective diameter portion is bounded by the edge. The one end of the sheath can be directed into the larger effective diameter portion and thereafter moved relative to the wall by being shifted transversely to the length of the cable to cause the edge to grippingly engage the surface of the one end of the sheath and thereby maintain the one end of the sheath in the predetermined operating orientation.

In one form, the latch system has a housing and an operator that is mounted to the housing for movement between a normal position and actuated positions, as an incident of which the latch system is changed between the latched state and released state. The one spaced end of the sheath is fixed to the housing in the predetermined operative orientation.

In one form, there are cooperating components on the one spaced end of the sheath and the housing that cooperate to allow the one spaced end of the sheath to be press fit and frictionally maintained in the predetermined operating orientation.

In one form, there is an edge on the housing that grippingly engages a surface on the one end of the sheath with the one end of the sheath in the predetermined operating orientation.

In one form, the edge is defined on a wall on the housing and there are first and second shoulders on the one end of the sheath that face towards each other and between which the housing wall captively resides to at least one of: (a) confine relative shifting of the one end of the sheath and housing wall lengthwise relative to the cable; and (b) maintain the predetermined operating orientation for the one end of the sheath.

In one form, the housing has a base and a mounting plate attached to the base and defining the housing wall. The mounting plate is maintainable selectively in a plurality of different fixed positions relative to the housing base, thereby to select different predetermined operating orientations for the one end of the sheath.

In one form, the latch system has a housing that is fixed relative to the base.

In one form, the base is in the form of a tubular element that defines the elongate tubular passageway. The tubular element has a bent configuration.

In one form, the actuating assembly has a frame that is mounted to the wall with the actuating element in operative engagement with the base and an actuating element that is movable relative to the frame between a normal position and an actuated position to thereby cause the cable core to move and thereby change the latch system from the latched state into the released state. The actuating assembly has a first component that engages the first operating portion of the cable core in a manner that the first operating portion of the cable core is pivotable relative to the first component about a first axis that is transverse to the length of the cable.

In one form, the first operating portion of the cable has a straight fitting with a length extending generally parallel to the first axis and guided within a receptacle in the first component.

In one form, the latch system has a housing and at least one rotor that is movable relative to the housing between latched and released positions.

In one form, the operating mechanism is provided in combination with a movable closure element to which the operating mechanism is attached.

In one form, the combination includes a frame support having a strike assembly. The movable element is mounted for movement between the predetermined position and a second position. The latch system engages the strike assembly with the movable element in the predetermined position and the latch assembly in the latched state.

In one form, the base has a support that extends into the tubular element and has a mounting flange to be placed against a movable closure element to which the operating mechanism is attached.

In one form, the operating assembly is provided in combination with a movable closure element to which the operating mechanism is attached. The latch system has a housing that is attached to the movable closure element.

In one form, there are no separate fasteners required to maintain the one spaced end of the sheath in the predetermined operating orientation.

In one form, the operator has a wall with a first surface and a slot. The cable core has an enlarged fitting at one of the spaced operating portions. The one of the spaced operating portions can be operatively engaged with the operator by moving the cable core into the slot in a direction transverse to the length of the slot to place the enlarged fitting in confronting relationship with the first surface. The enlarged fitting bears against the first surface and thereby causes the operator to change from its normal position into its actuated position as an incident of the actuating system being changed from its first state into its second state.

The invention further is directed to a method of assembling an operating mechanism for a movable closure element. The method includes the steps of: providing a base having a tubular element bounding a passageway; and providing a latch system with a movable operator and having: (a) a latched state in which the latch system engages a strike element so as to maintain a movable closure element, on which the operating mechanism is mounted, in a predetermined position; and (b) a released state wherein the latch system can be disengaged from a strike element so as to allow a movable closure element, on which the operating mechanism is mounted, to be moved from the predetermined position. The method further includes the step of providing an actuating system with a first movable component on the base and changeable from a first state into a second state to thereby change the latch system from the latched state into the released state. The step of providing an actuating system further involves providing an actuating system with an elongate flexible cable with a sheath having spaced ends and a core with first and second operating portions. The method further includes the steps of: directing the flexible cable through the passageway; press fitting the sheath ends each into a predetermined operating orientation relative to the base; and operatively engaging the first and second operating portions, one each with the operator and the first movable component on the actuating system at spaced first and second locations, by moving the first and second operating portions relative to the operator and first movable component.

In one form, the step of providing a base involves providing a tubular element with a bent configuration such that the elongate cable cannot be extended in a straight line between the first and second spaced locations.

In one form, the step of press fitting the sheath ends involves press fitting the sheath ends so that the sheath ends are each maintained in its operative orientation without the requirement for separate fasteners.

In one form, the method further includes the step of changing the predetermined operating orientation of one of the sheath ends.

DETAILED DESCRIPTION OF THE DRAWINGS

Figure 1:
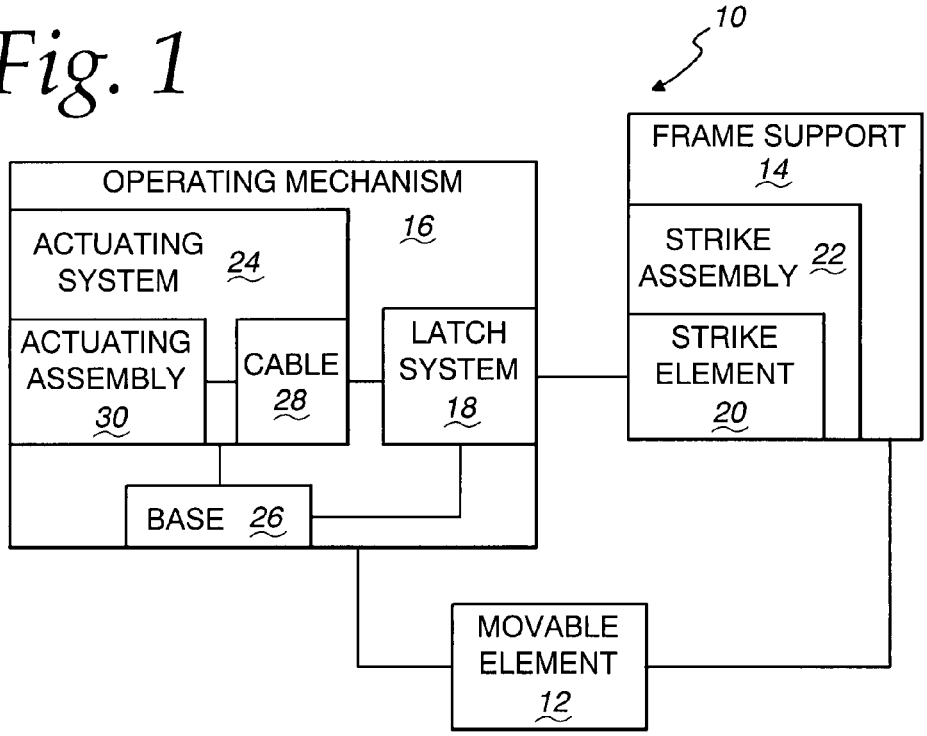
FIG. 1 is a schematic representation of a system, according to the invention, including a movable element mounted upon a frame support and having an operating mechanism thereon which releasably maintains the movable element in a predetermined position relative to the frame support through engagement between a latch system on the movable element and a strike assembly on the frame support.

A schematic representation of a system, according to the present invention, is shown at 10 in FIG. 1. The system 10 includes a movable element 12 that may be virtually any type of element, such as a closure element, in either a static or dynamic environment, that is movable between first and second different positions relative to a frame support 14, and releasably maintainable in a predetermined position relative to the frame support 14. The movable element may be repositionable by movement pivotably, translationally, etc., relative to the frame support 14 between the first and second positions. An operating mechanism 16 is mounted on the movable element 12. The operating mechanism 16 has an associated latch system 18 having: (a) a latched state, wherein the latch system 18 engages a strike element 20 on a strike assembly 22 on the frame support 14 so as to maintain the movable element 12 in the predetermined position therefor; and (b) a released state, wherein the latch system 18 can be disengaged from the strike element 20 so as to allow the movable element 12 to be moved from the predetermined position.

The latch system 18 is changed from the latched state into the released state through an actuating system 24 mounted upon a base 26 on the movable element 12. The actuating system 24 includes an elongate, flexible cable 28 that is operated by an actuating assembly 30. The cable 28 is operatively connected to each of the latch system 18 and actuating assembly 30, as shown more particularly in FIG. 2.

Figure 2:
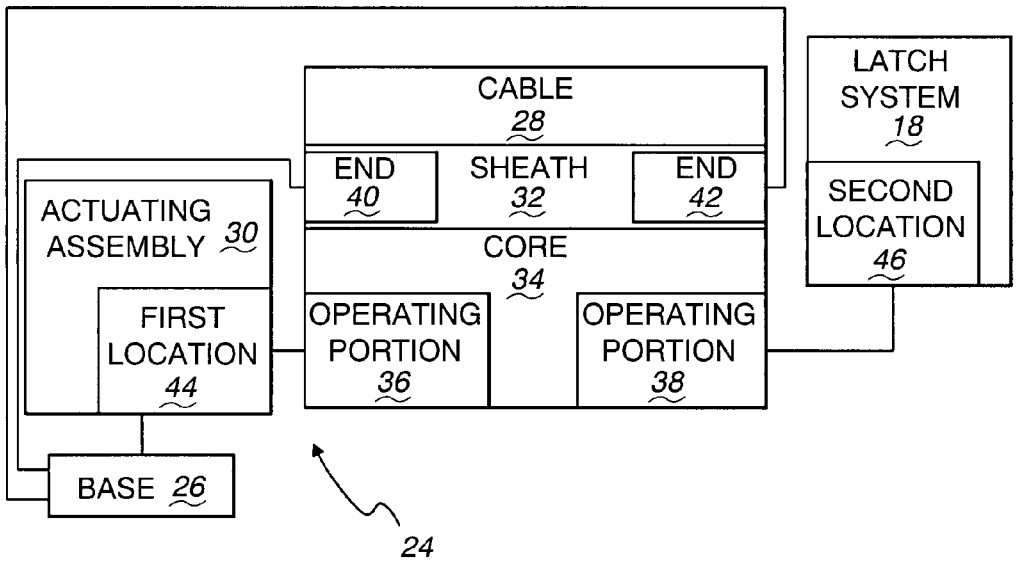
FIG. 2 is a schematic representation of an actuating system on the operating mechanism in FIG. 1 that operates the latch system through a flexible cable.

As seen in FIG. 2, the cable 28 consists of an elongate sheath 32 and a core 34 that is movable guidingly lengthwise relative to, and within, the sheath 32. The cable core 34 has operating portions 36, 38 spaced lengthwise of the cable 28. The sheath 32 has spaced ends 40, 42 each fixed relative to the base 26 in a predetermined operating orientation. One operating portion 36 of the cable core 34 is operatively engaged with the actuating assembly 30 at a first location 44 thereon, with the other operating portion 38 operatively engaged with the latch system 18 at a second location 46 thereon.

Through operation of the actuating assembly 30, the actuating system 24 is changeable from a first state into a second state to thereby change the latch system 18 from the latched state into the released state This operation is effected through the cable 28 and, more particularly, by guided movement of the core 34 within the cable sheath 32.

The system 10 is designed to be useable in a construction wherein the cable 28 can be extended in a straight line between the first an second locations 44, 46. However, the system 10 is designed particularly to be operable in system configurations wherein the cable 28 cannot be extended in a straight line between the first and second locations 44, 46, and as shown in detail hereinbelow.

In one preferred form, the cable 28 is constructed so that the sheath ends 40, 42 can each be placed and frictionally maintained in a predetermined operating orientation through a simple press fit step. Likewise, through simple relative movement between the operating portions 36, 38 of the core 34 and actuating assembly 30 and latch system 18, respectively, the operative relationship between the core 34 and actuating assembly 30 and latch system 18 can be established. Accordingly, it is possible to operatively connect the cable 28 from a separated position, and maintain the cable 28 operatively connected, without requiring the use of separate fasteners. Of course, some or all of the above-described connections might be maintained using separate fasteners consistent with the inventive concepts.

The system 10 is shown in generic form because it is contemplated that the environment for the present invention and the configuration thereof may take myriad different forms. One exemplary environment for, and form of, the present invention, will now be described. It should be understood that the following description is intended to be exemplary in nature only and not limited to the specific structure shown and described.

Figure 3:
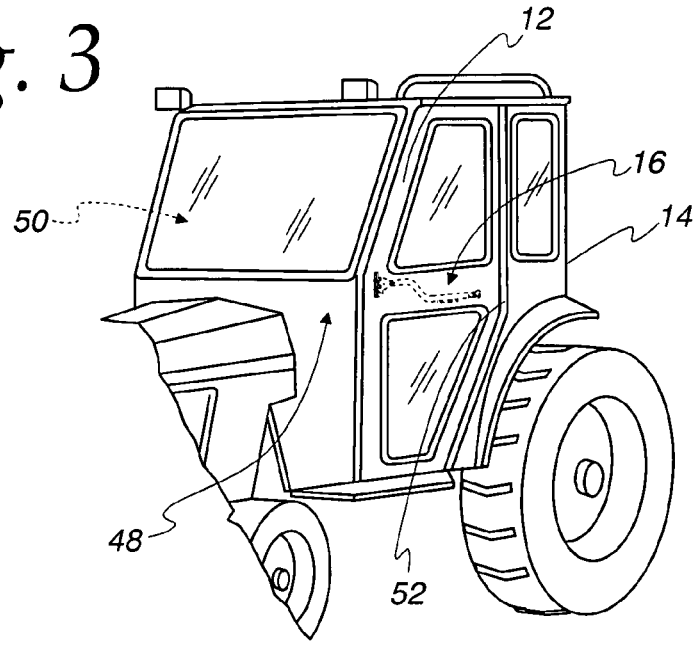
FIG. 3 is a fragmentary, perspective view of a frame support in the form of an agricultural implement having a movable element in the form of a closure, with the inventive operating mechanism thereon and the closure in a predetermined closed position.
Figure 4:
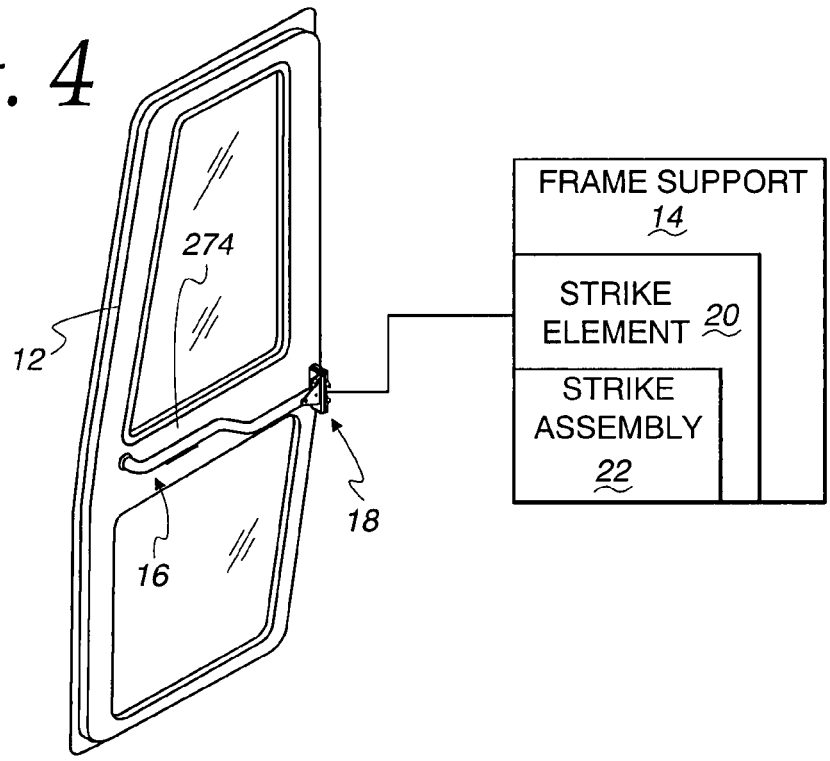
FIG. 4 is an enlarged, fragmentary, partially schematic representation of the agricultural implement of FIG. 3 with the closure in an open position.

In FIGS. 3 and 4, the frame support 14 is shown as a wheeled agricultural implement having a cab at 48 with an internal compartment 50 that can be occupied by a user. The cab 48 has an access opening 52 that can be selectively closed and exposed by the movable element 12, that is in the form of a closure. The closure 12 is movable relative to the frame support 14 selectively between a closed position, as shown in FIG. 3, and an open position, as shown in FIG. 4. The closure 12 is releasably maintained in the closed position through cooperation between the latch system 18 on the operating mechanism 16 and the strike element 20 on the strike assembly 22, as hereinafter described. The operating mechanism 16 has many similarities to that shown in Applicant's own U.S. Pat. No. 7,198,308, the disclosure of which is incorporated herein by reference.

Figure 15:
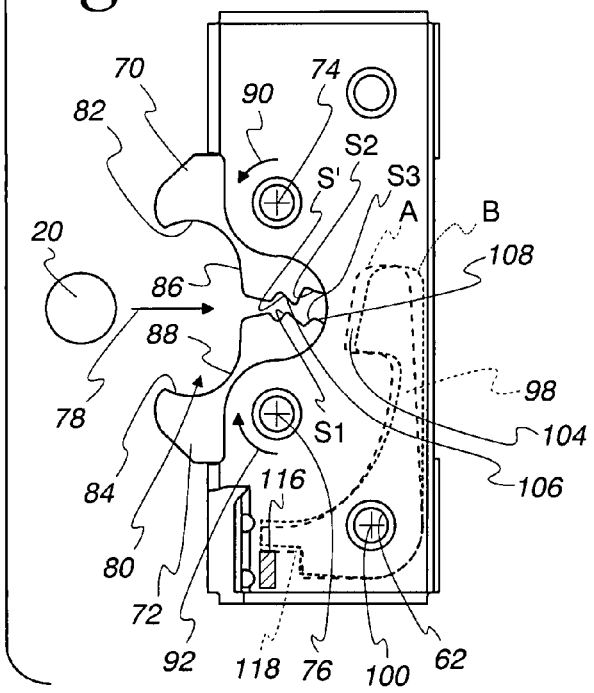
FIG. 15 is a side elevation view of the latch system with rotors thereon in a released position and in relationship to a strike element, towards which the latch system is being moved, as the closure element is repositioned.
Figure 16:
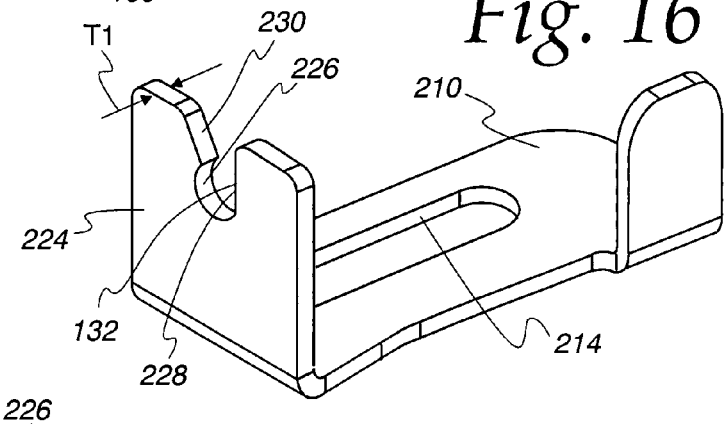
FIG. 16 is an enlarged, perspective view of a mounting plate on the latch system for mounting one end of a sheath on the cable.
Figure 17:
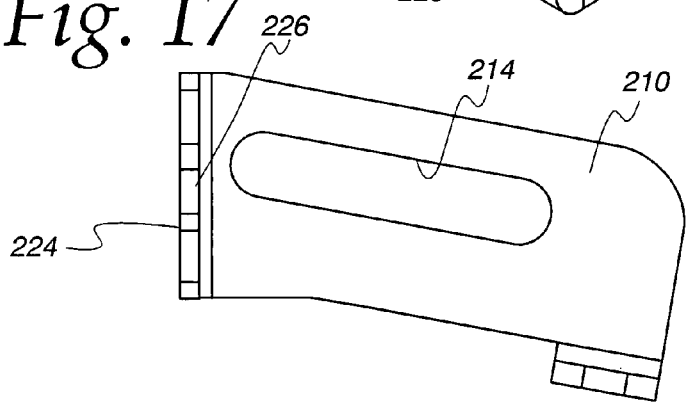
FIG. 17 is an enlarged, rear elevation view of the mounting plate in FIG. 16.
Figure 18:
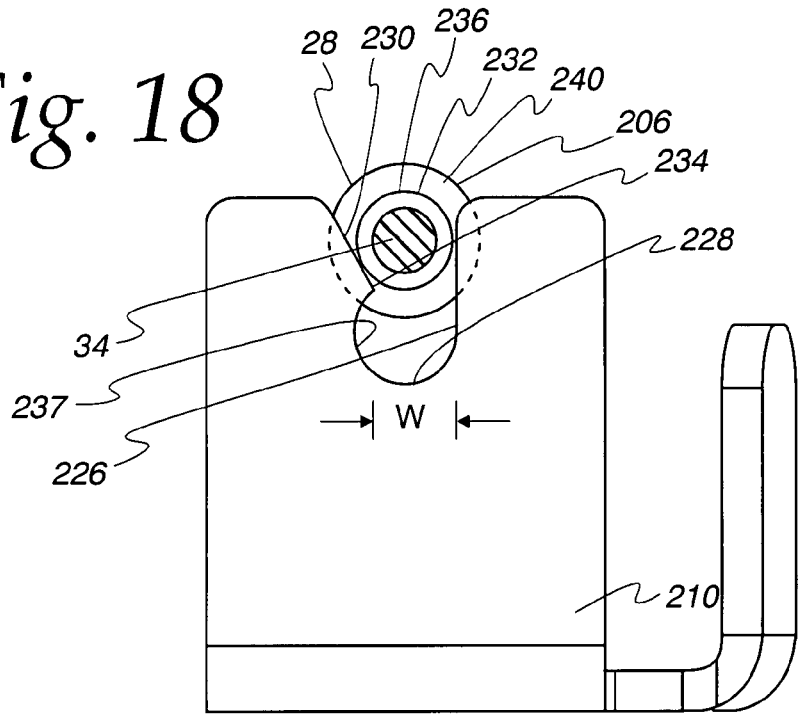
FIG. 18 is an enlarged, side elevation view of the mounting plate in FIGS. 16 and 17 with one end of the cable sheath press fit thereto.
Figure 19:
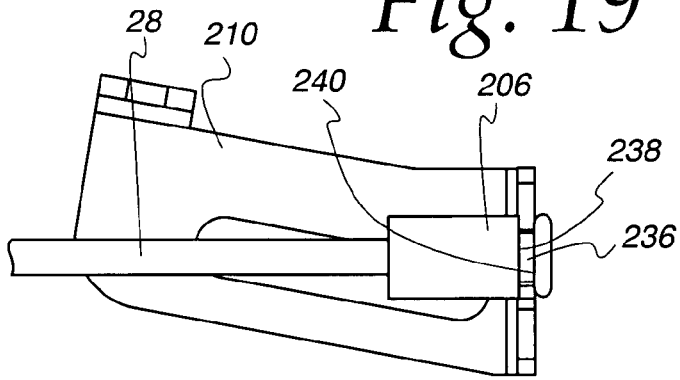
FIG. 19 is a fragmentary, rear elevation view of the connection of the cable sheath end and mounting plate as shown in FIG. 18.
Figure 20:
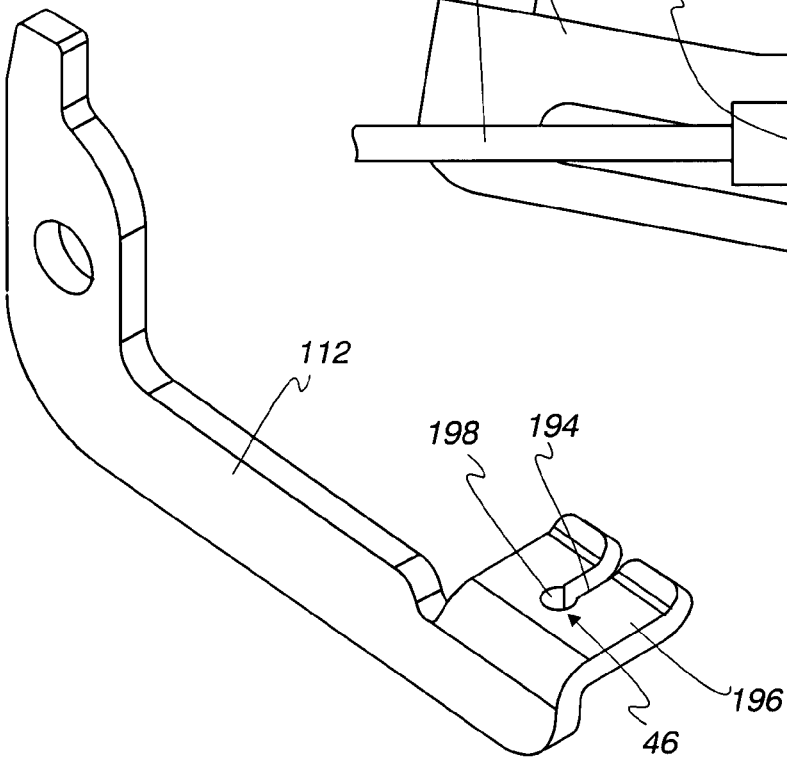
FIG. 20 is an enlarged, perspective view of an operator/trip lever on the latch system.

Details of the operating mechanism 16 are shown in FIGS. 5-29, in association with a strike element 20 (FIG. 15). As seen in those Figures, the operating mechanism 16 consists of the base 26, the actuating system 24, and the latch system 18. The actuating system 24 in turn consists of the actuating assembly 30 and the cable 28.

Figure 5:
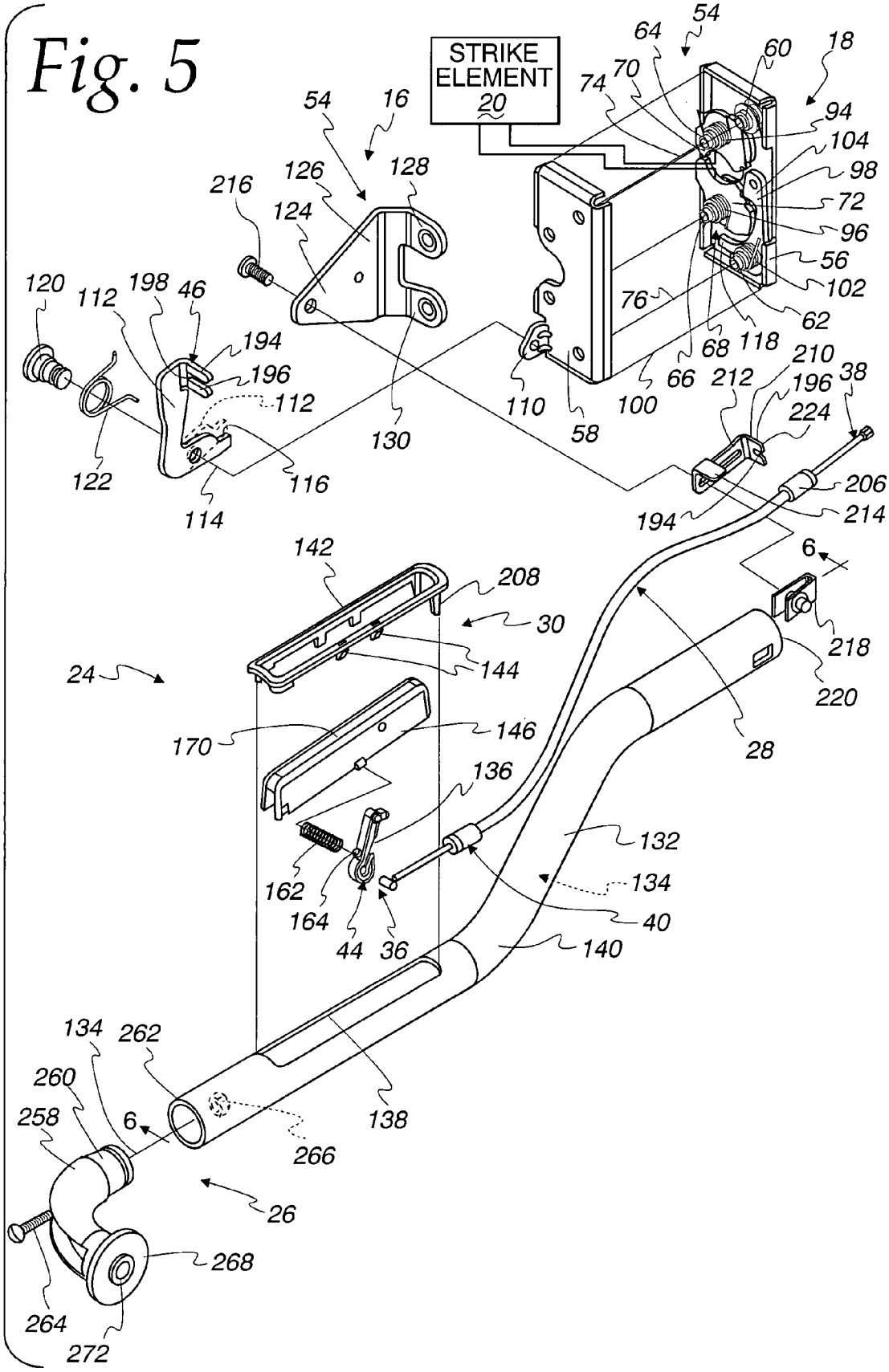
FIG. 5 is an enlarged, exploded, perspective view of the operating mechanism in FIGS. 3 and 4.
Figure 6:
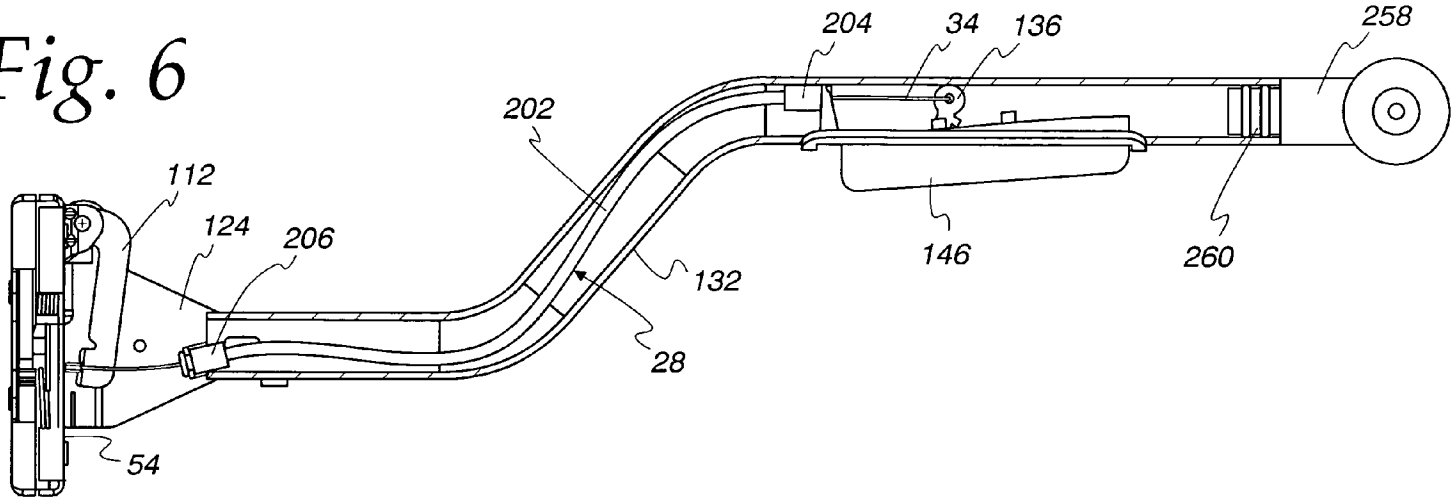
FIG. 6 is a rear elevation view of the operating mechanism in FIG. 5 and with a tubular element sectioned along line 6-6 of FIG. 5 and with an actuating element on the actuating system in a normal position and the latch system in a latched state.
Figure 7:
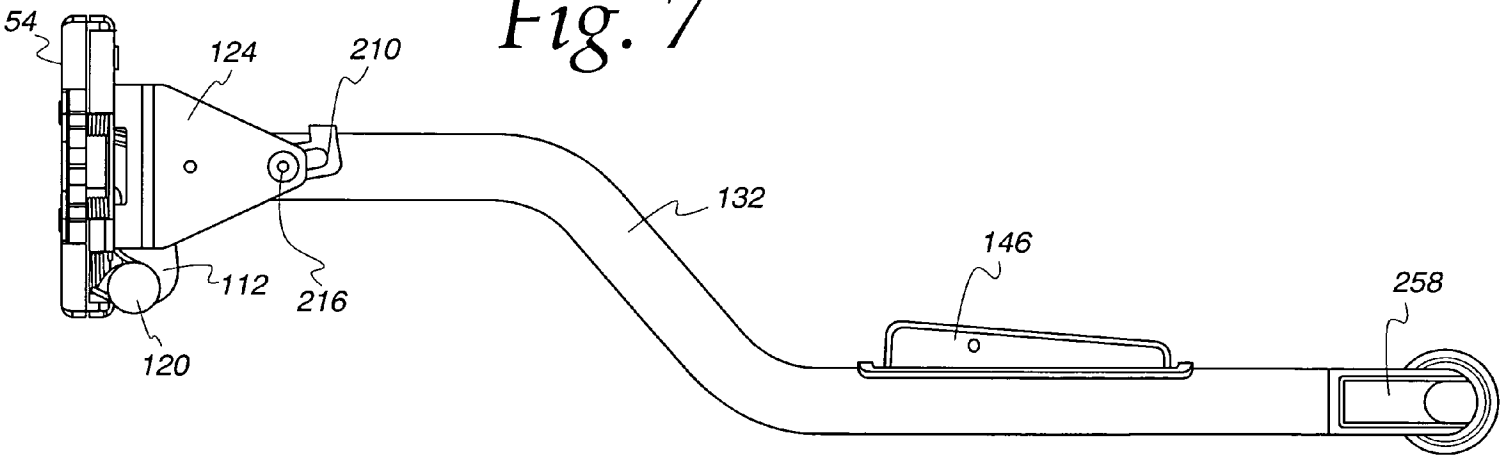
FIG. 7 is a front elevation view of the operating mechanism in the FIG. 6 state.
Figure 8:
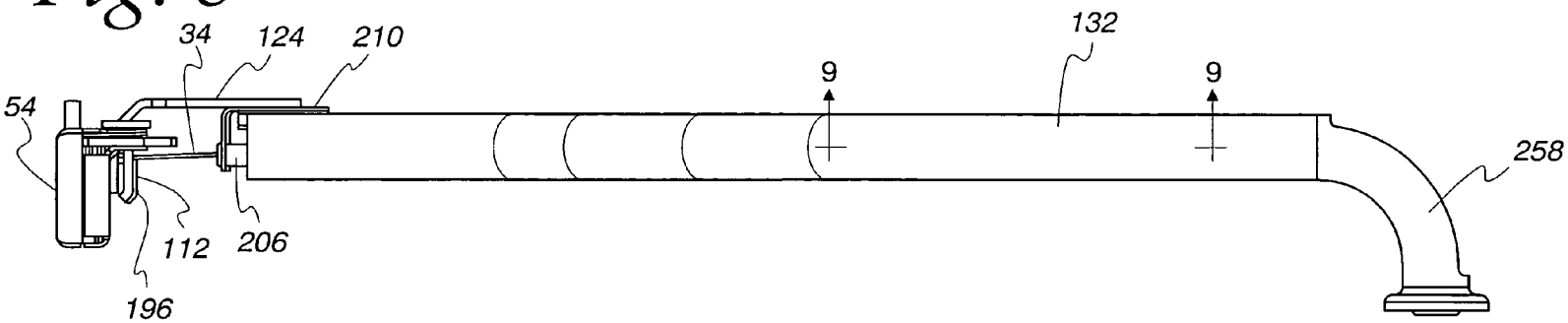
FIG. 8 is a plan view of the operating mechanism in the FIG. 6 state.

The latch system 18 consists of a multi-part housing 54. Details of operation of a like latch system 18 are set forth in U.S. Pat. No. 7,198,308. Briefly, the housing 54 is defined by separate housing parts 56, 58 that are joined through axles 60, 62, 64, 66 to bound a compartment 68 for a pair of rotors 70, 72. The ends of the axles 60, 62, 64, 66 are deformed to permanently maintain the fixed relationship of the housing parts 56, 58. The axles 64, 66 guide movement of the rotors 70, 72 respectively around axes 74, 76 between released positions, as shown in FIG. 15, and latched positions, as shown in FIG. 5. With the rotors 70, 72 in their released positions, movement of the movable element 12 towards the predetermined position therefor causes the strike element 20 on the strike assembly 22 to approach the rotors 70, 72 in the line of the arrow 78 in FIG. 15 and move into an opening 80 bounded partially by curved rotor surfaces 82, 84. Continued movement of the movable element 12 causes the strike element 20 to bear simultaneously against surface portions 86, 88 on the rotors 70, 72, thereby progressively producing a biasing force on the rotors 70, 72 in the direction of the arrows 90, 92 around their respective axes 74, 76. As this occurs, the surfaces 82, 84 progressively close around the strike element 20 and eventually fully surround the same with the rotors 70, 72 in their latched positions.

Normally the rotors 70, 72 are biasably urged towards their released positions by torsion coil springs 94, 96. With the rotors 70, 72 in their released positions, the strike element 20 must be caused to bear against the rotor surface portions 86, 88 with a sufficient force to overcome the bias of the springs 94, 96 and effect pivoting movement thereof around the axes 74, 76 towards their released positions.

An L-shaped catch 98 is mounted to the axle 62 for pivoting movement around an axis 100 between an engaged position, as shown in FIG. 5 and in dotted lines at A in FIG. 15, and a disengaged position, as shown in dotted lines at B in FIG. 15. The catch 98 is normally urged towards the engaged position therefor by a torsion coil spring 102 that surrounds the axle 62.

With the catch 98 in the disengaged position, the rotors 70, 72 are free to pivot between the latched and released positions therefor. As the strike element 22 progressively urges the rotors 70, 72 from their released positions towards their latched positions, a head 104 on the catch 98 moves between toothed edges 106, 108 on the rotors 70, 72, respectively. The toothed edges 106, 108 cooperatively define shoulder pairs S, S1; S2, S3 that are alternatively simultaneously engaged by the head 104 of the catch 98, thereby to maintain the rotors 70, 72 in different latched positions. There are preferably primary and secondary latched positions for the rotors 70, 72, with additional latched positions possible by providing additional teeth. With this arrangement, the head 104, the catch 98 and toothed edges 106, 108 cooperatively produce a ratchet-type action as the rotors 70, 72 are moved from their released position into their secondary latched positions, and ultimately into their primary latched positions.

The housing part 58 has a mounting tab 110 thereon upon which an operator/trip lever 112 is mounted for pivoting movement about an axis 114. The operator/trip lever 112 is movable around the axis 114 between a normal position, as shown in solid lines in FIG. 5, and an actuated position shown for a portion thereof in dotted lines in that same Figure. As this occurs, a shoulder 116 on the operator/trip lever 112 bears against a shoulder 118 on the catch 98, thereby changing the catch 98 from its engaged position into its disengaged position. The operator/trip lever 112 is mounted for pivoting movement relative to the housing 54 through a rivet 120 and is normally biased towards its normal position by a torsion coil spring 122. As explained hereinbelow, the operator/trip lever 112 is operated by the cable 28, and more particularly by the movement of the core 34 thereon, which engages the operator/trip lever 112 at the aforementioned second location 46.

The housing 54 additionally includes an extension plate 124 that has a flat mounting portion 126 and transverse attaching legs 128, 130 that are placed facially against the outside of the housing part 58. The axles 64, 66 extend through the attaching legs 128, 130 and secure the connection of the extension plate 124 to the housing plate 58 so that the housing 54 and extension plate together define a fixed base 131.

The base 26 consists of a tubular element 132, preferably consisting of one piece formed into a curved or bent shape. In this particular embodiment, the tubular element has an overall "S" shape. However, this particular configuration is not significant as any non-straight shape for the tubular element 132 is contemplated. As just one example, the tubular element may be bent to be offset along three different axes. As explained in greater detail below, the cable 28 extends through a passageway 134 defined and bounded by the tubular element 132. The operating portion 36 of the core 34 engages a first movable component 136 on the actuating assembly 30 at the first location 44. The tubular element 132 is configured so that the cable 28 cannot be extended in a straight line between the first location 44 and the second location 46, where the operating portion 38 of the core 34 engages the operator/trip lever 112 on the latch system 18. Consequently, the cable 28 must be bent to conform to the shape of the tubular element 132, as shown most clearly in FIG. 6.

Figure 9:
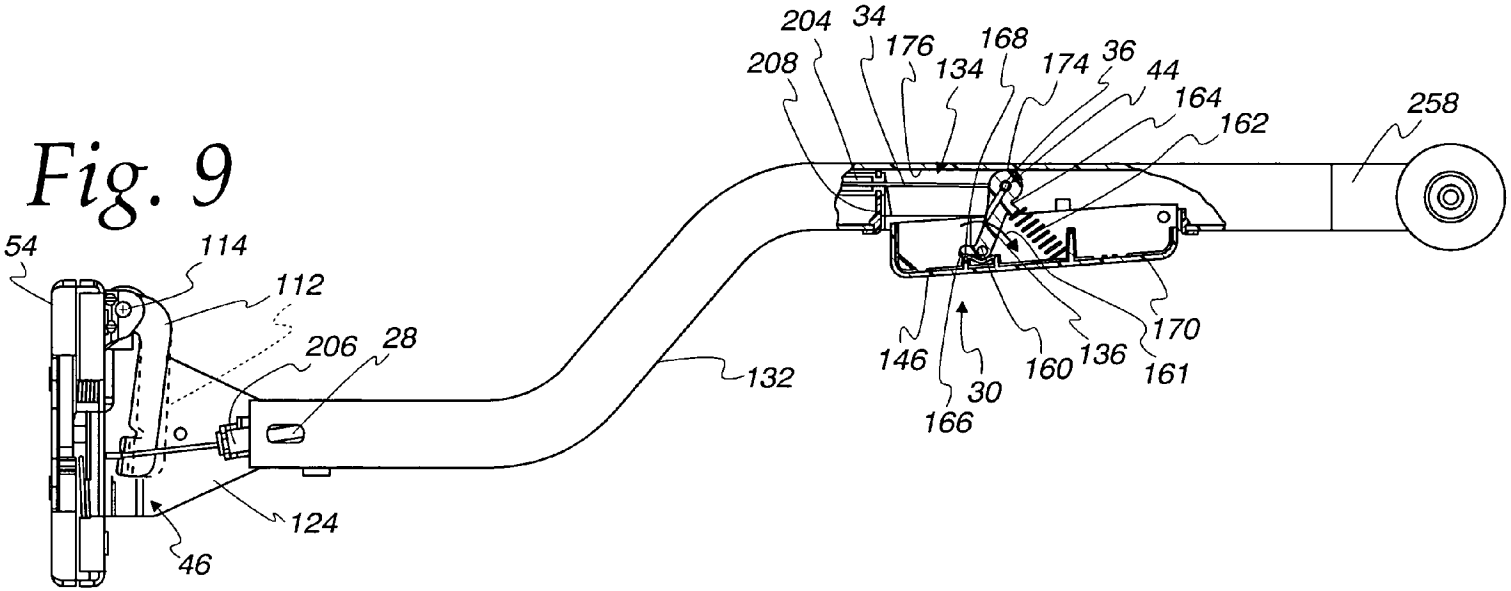
FIG. 9 is a view as in FIG. 6 with the operating mechanism sectioned along line 9-9 of FIG. 8.

The actuating assembly 30 has substantially the same construction as that shown in U.S. Pat. No. 7,198,308 and is mounted in an opening 138 in a wall 140 on the tubular element 132 that extends around an axis 141 for the passageway 134. More particularly, the actuating assembly 30 has a rectangular frame 142 that is conformed generally to the shape of the wall opening 138 and snap-fit thereinto, and maintained in an operative position, by a plurality of deflectable tabs 144. The frame 142 has stub shafts 145 that project towards each other and guide pivoting movement of an actuating element 146, that is part of the actuating assembly 30, between a normal position, as shown in FIG. 9, and an actuated position, shown in FIG. 10.

The first movable component 136 has a pair of oppositely projecting stub shafts 148, 150 which project, one each, into openings 152, 154 in spaced walls 156, 158 on the actuating element 146. Through this arrangement, the movable component 136 is repositionable by guided movement around an axis 160, defined by the stub shafts 148, in a direction indicated by the arrow 161, between a first position, shown in FIG. 9, and a second position, shown in FIG. 10.

A coil spring 162 surrounds a post 164 on the movable component 136 and urges the movable component around the axis 160 towards the first position therefor. A surface 166 on the movable component 136 abuts to a raised boss 168 on a wall 170 on the actuating element 146, thereby to limit pivoting movement of the movable element 136 around the axis 160 oppositely to the direction of operating movement indicated by the arrow 161 in FIG. 9. A rounded edge 174 on the first movable component 136, remote from the surface 166, bears upon an inside surface 176 of the wall 140 on the tubular element 132, at a location diametrically opposite to the opening 138. Through this arrangement, the coil spring 162 biases the movable component 136 in a manner that it exerts a force on the actuating element 146, tending to move the same towards its normal position in FIG. 9. A pair of tabs 178 on the actuating element 146 abuts to the frame 142 to limit movement of the actuating element 146 from its actuated position to beyond its normal position by pivoting movement opposite to the direction of the arrow 172.

The tubular element 132 and actuating assembly 30 are configured so that a user can place his/her hand so that it surrounds the tubular element 132 and actuating assembly 30. Through a squeezing action, the actuating element 146 can be repositioned from its normal position and maintained in its actuated position by the grasping hand, which is conveniently situated to reposition the closure element 12.

Figure 10:
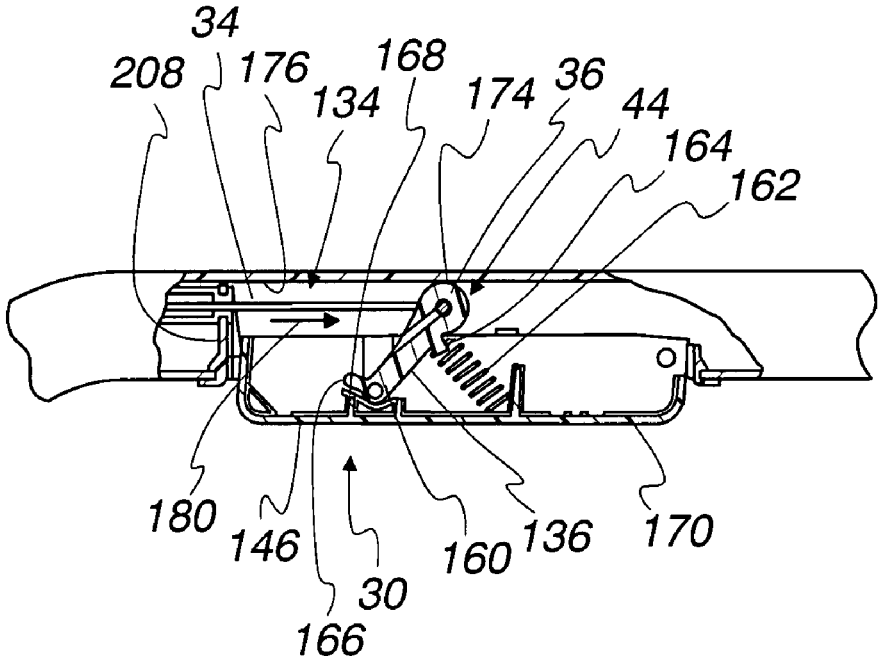
FIG. 10 is a view of the operating mechanism as in FIG. 9 wherein the actuating element is changed to an actuated position which causes the latch system to be changed into the released state.
Figure 11:
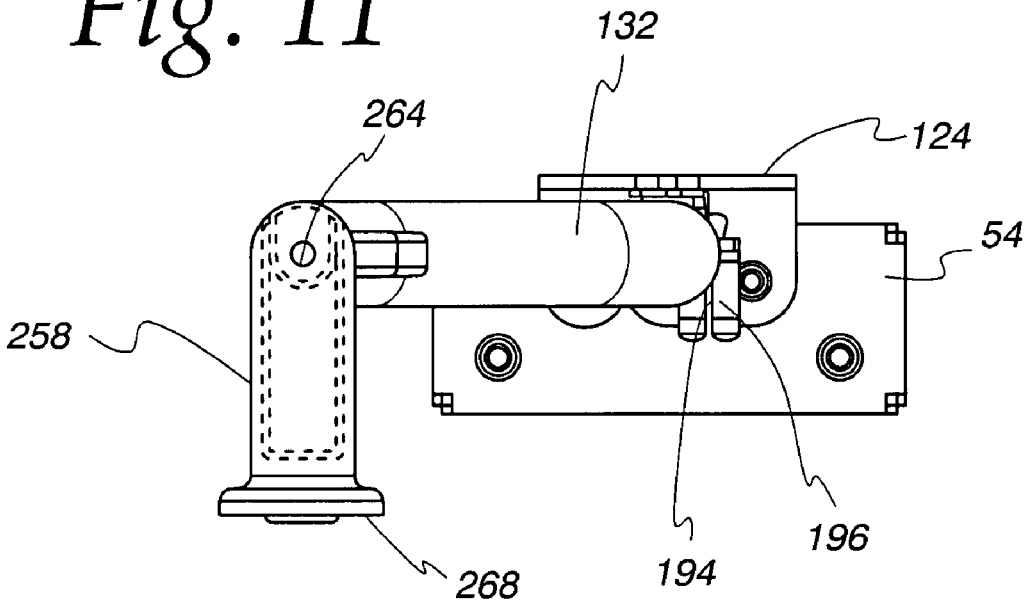
FIG. 11 is a side elevation view of the operating mechanism in the FIG. 6 state.
Figure 13:
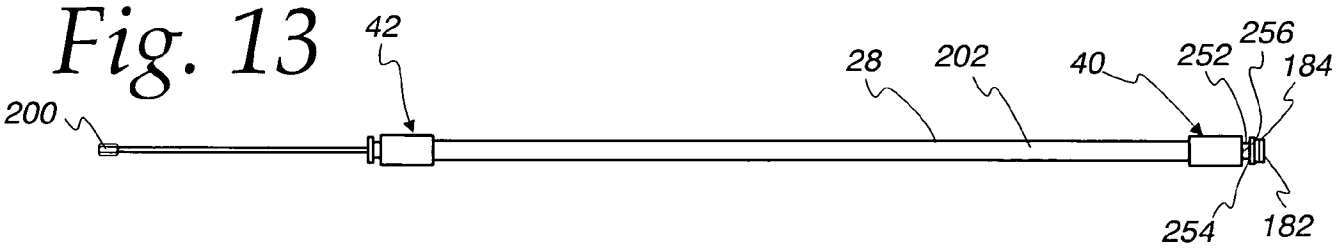
FIG. 13 is an elevation view of the cable in FIG. 12.
Figure 14:
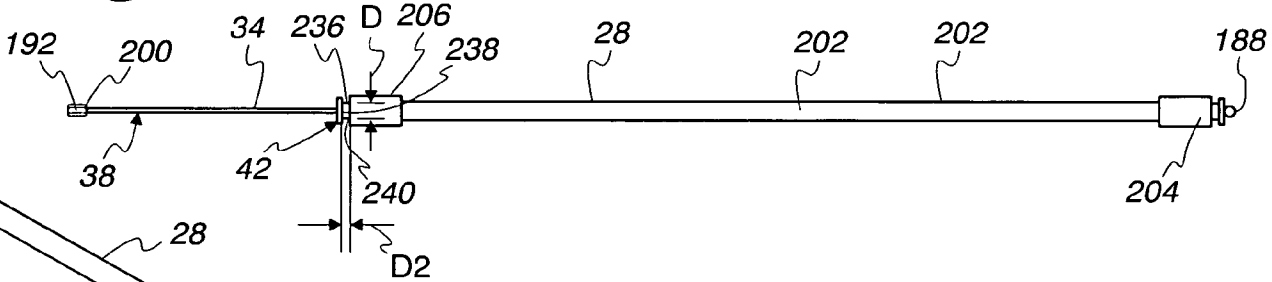
FIG. 14 is a view as in FIG. 13 with the cable turned 90° around its length.
Figure 12:
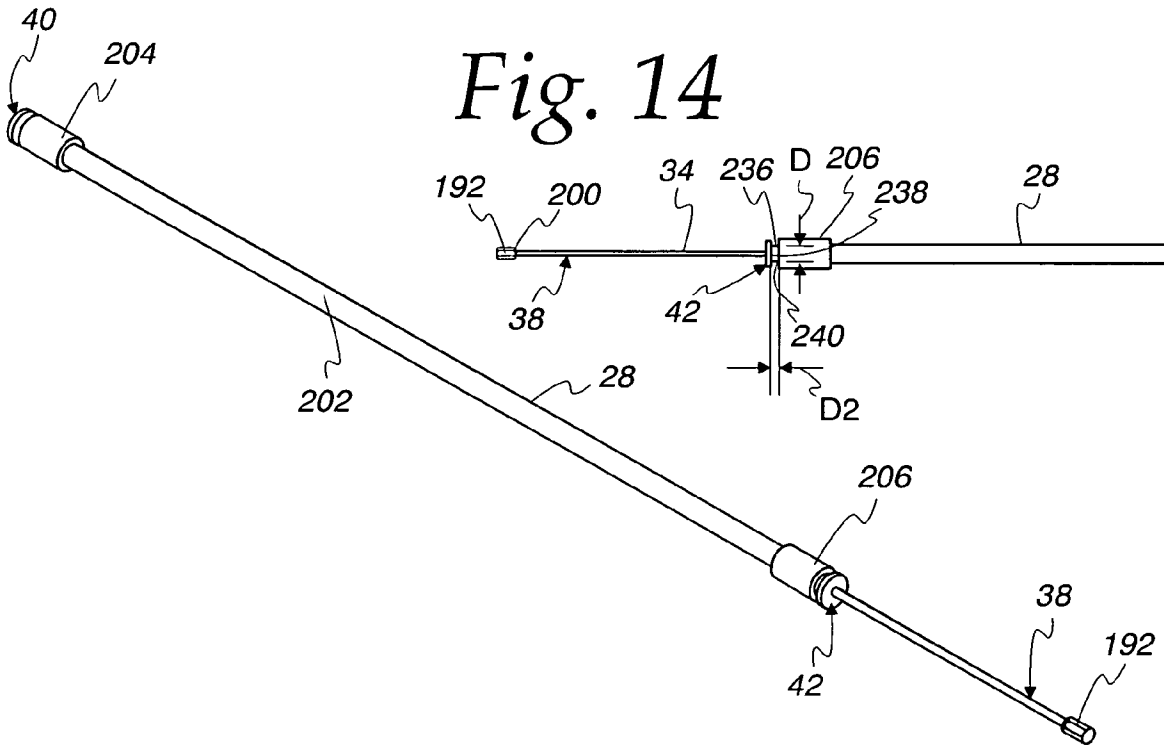
FIG. 12 is a perspective view of the cable that acts between the actuating assembly and latch system.

With the ends 40, 42 of the cable sheath 32 fixed relative to the base 26, changing of the actuating element 146 from its normal position into its actuated position causes the core 34 to shift lengthwise with respect to the tubular element 132 in the direction of the arrow 180 in FIG. 10. As this occurs, the operating portion 38 of the cable core 34 at the second location 46 repositions the operator/trip lever 112 from its normal position into its actuated position, which in turn changes the catch 98 from the engaged position to the disengaged position, thereby changing the latch system 18 from its latched state into its released state, whereupon the rotors 70, 72 are changed from their latched positions into their released positions.

In a preferred form, the cable core 34 has a braided metal construction. The free end 182 of the operating portion 36 of the core 34 has a straight, cylindrically-shaped fitting 184 that is pressed into a receptacle 186 on the movable component 136 to allow relative movement therebetween around the axis 188 of the fitting 184, that aligns with the axis 189 of the receptacle 186. The movable component 136 has a cut-out 190 that facilitates connection of the operating portion 36 and movable component 136 through simple relative movement therebetween, and accommodates the cable core 34 as relative movement between the fitting 184 and movable component 136 takes place as the mechanism 16 is operated.

The operating portion 38 of the cable 28 has an enlargement 192 thereon. The operating portion 38 is engaged at the second location 46 by directing the cable core 34 through a slit 194 defined by a bifurcated wall 196. The enlargement 192 nests in a rounded receptacle 198 at the base of the slit 194 that is complementary to a rounded end 200 on the enlargement 192.

The sheath ends 40, 42 are fixed relative to the base 26, each in a predetermined operating orientation that optimizes force transmission to and by the core 34. That is, the sheath end 42 is aligned so that a straight length of the cable 28 thereat is aligned at the second location 46 to maximize the component of force that pivots the operator/trip lever 112. The sheath end 40 is aligned with respect to the movable component 136 to achieve the same objective.

The sheath 32 has a main conduit 202 that slidingly guides movement of the core 34, which has a length that is greater than that of the sheath 32 to permit the relative sliding movement therebetween with each of the operating portions 36, 38 exposed, as described herein. End couplings 204, 206, of like construction, are fixedly secured to the conduit 202 at the sheath ends 40, 42, respectively. The end couplings 204, 206 are components that respectively cooperate with components 208, 210 on the frame 142 and extension plate 124. The end couplings 204, 206 each has a straight length that guides the core 34 in a straight path where the core 34 passes therethrough. The component 208 is an integral wall on the frame 142, whereas the component 210 is in the form of an L-shaped plate that is separately mounted to the mounting portion 126 of the extension plate 124.

The mounting plate 210 has a wall 212 that is placed facially against the extension plate 124 on the base 131. The wall 212 has an elongate through slot 214 to receive a threaded fastener 216 that is directed through the extension plate 124 and into a U-nut 218 that straddles the wall 140 of the tubular element 132 adjacent the lengthwise end 220 thereof. With the fastener 216 extended through the extension plate 124, the slot 214 on the wall 212, and the wall 140 on the tubular element 132 and into the U-nut 218 residing within the passageway 134, the fastener 216 can be tightened to fix the orientation of the mounting plate 210 relative to the extension plate 124. The elongate slot 214 permits translational and angular reorientation of the mounting wall 212 relative to the extension plate 124 to select the orientation of the sheath end 42 that optimizes force transmission thereto and therefrom. The mounting plate 210 can be fixed in any of virtually a limitless number of different positions for this purpose.

The mounting plate 210 has a wall 224 that is substantially orthogonal to the wall 212. The wall has a receptacle 226 for the sheath end 42 and, more particularly, for the end coupling/component 206.

The receptacle 226 is bounded by a concave edge 228. The receptacle 226 has edge portions 230, 232 that converge towards the concave edge 228. A restricted passage 234 is defined at the juncture between the edge portion 230 and concave edge 228. The passage has a width W (FIG. 18) that is slightly less than the diameter D (FIG. 14) of a cylindrical surface 236 on the end coupling/component 206. Accordingly, the surface 236 must be deformed radially inwardly to allow passage of the surface 236 to within the receptacle portion 237 defined by the concave edge 228. Through this arrangement, the surface 236 is press fit into the receptacle 226 and grippingly engaged by the edge 228, whereby the end coupling/component 206, and thus the sheath end 42, are positively, frictionally maintained in a predetermined operating orientation, as dictated by the selected orientation of the plate 210.

The surface 236 is radially undercut, whereby the end coupling/component 206 defines first and second shoulders 238, 240 that face axially towards each other and axially bound the surface 236. The shoulders 238, 240 are spaced from each other a distance D2 that is nominally equal to the thickness T1 of the wall 224. The wall 224 may fit snugly between the shoulders 238, 240 or may be wedged therebetween, whereby the shoulders 238, 240 prevent relative shifting of the sheath end 42 and wall 224 lengthwise of the cable 28. At the same time, this tight captive arrangement of the wall 224 between the shoulders 238, 240 positively maintains the predetermined orientation for the sheath end 42.

Figure 21:
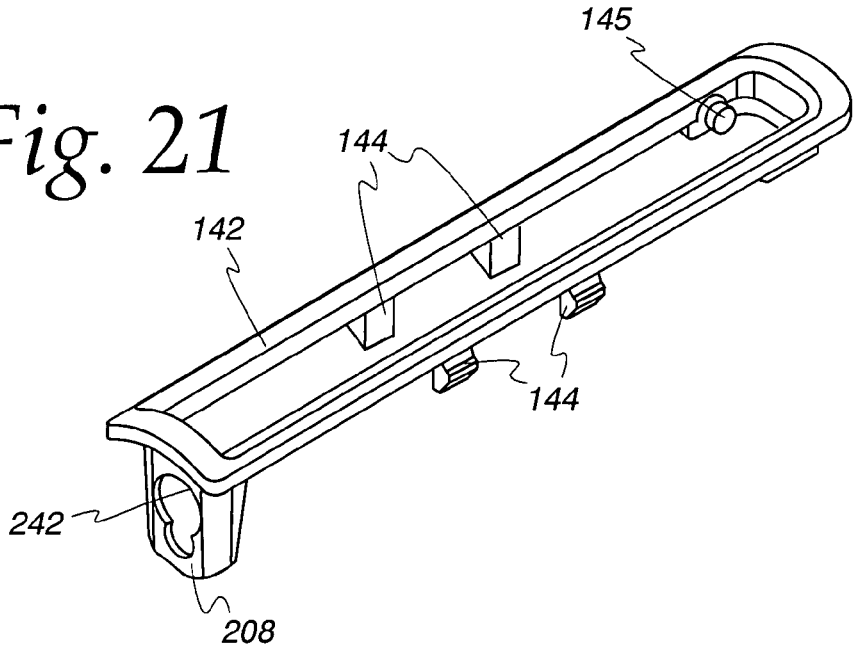
FIG. 21 is an enlarged, perspective view of a frame on the actuating assembly that mounts to the tubular element and supports the actuating element for guided movement between its normal and actuated positions.
Figure 22:
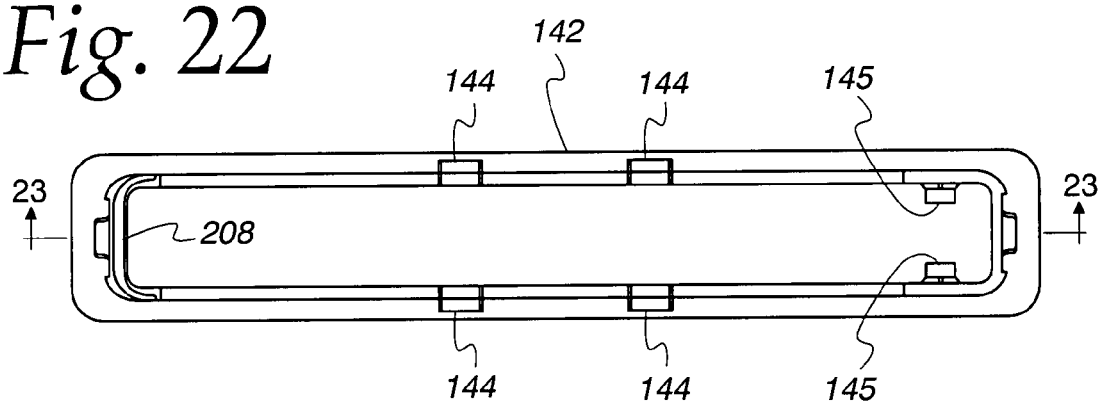
FIG. 22 is an enlarged, plan view of the frame in FIG. 21.
Figure 23:
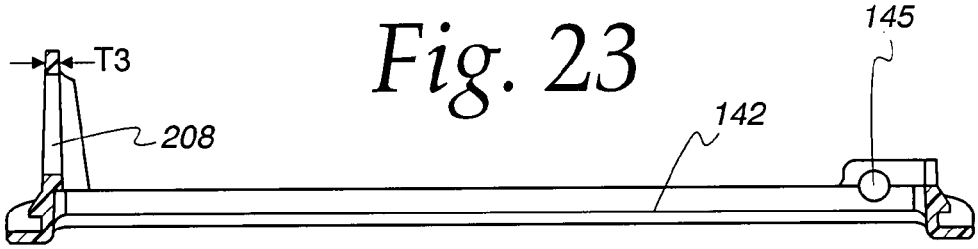
FIG. 23 is a cross-sectional view of the frame taken along line 23-23 of FIG. 22.
Figure 24:
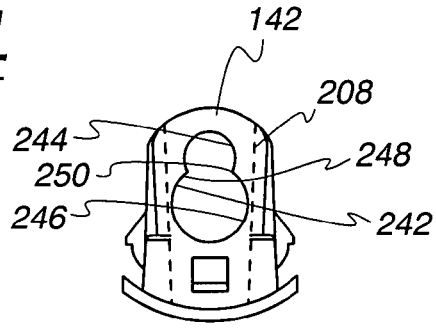
FIG. 24 is an enlarged, side elevation view of the frame in FIGS. 21-23.
Figure 25:
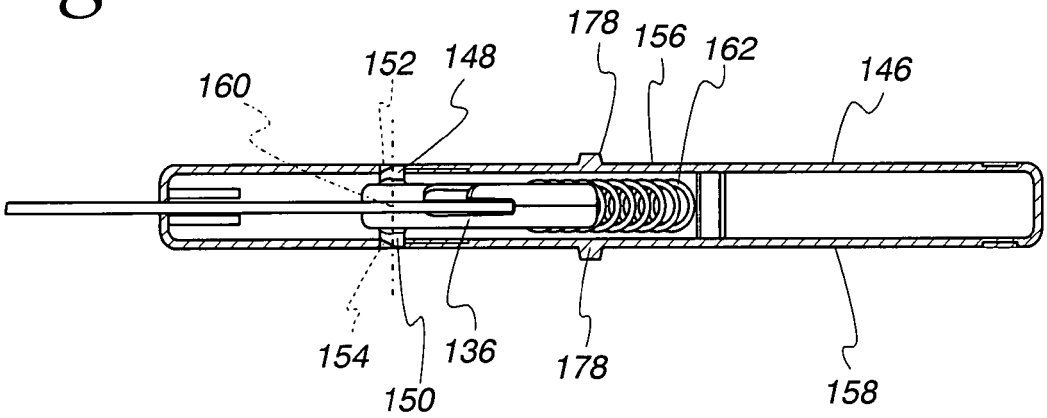
FIG. 25 is a plan view of the actuating element with a movable component therein that attaches to an end of the cable core.
Figure 26:
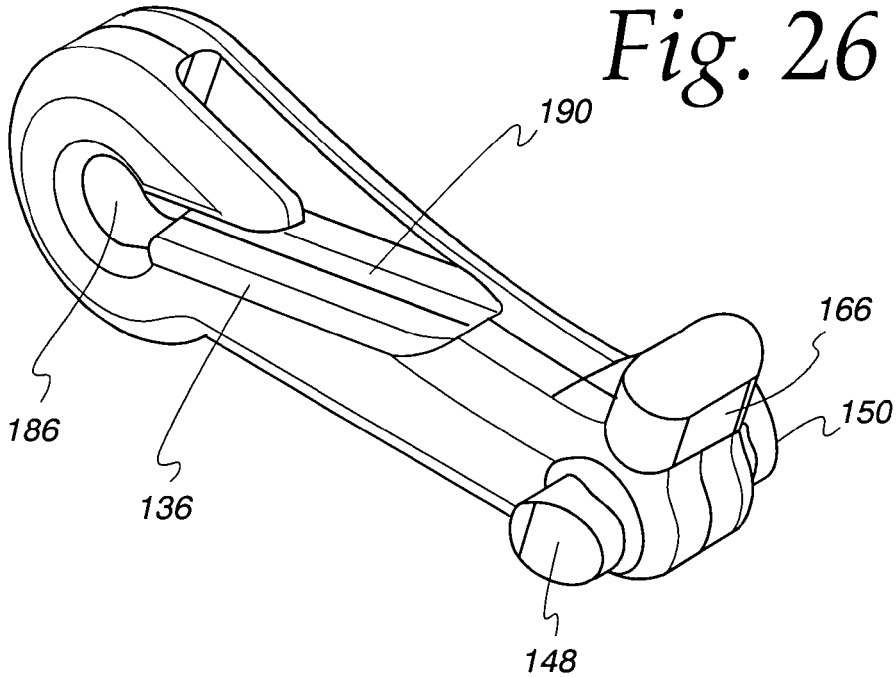
FIG. 26 is an enlarged, perspective view of the movable component in FIG. 25.
Figure 27:
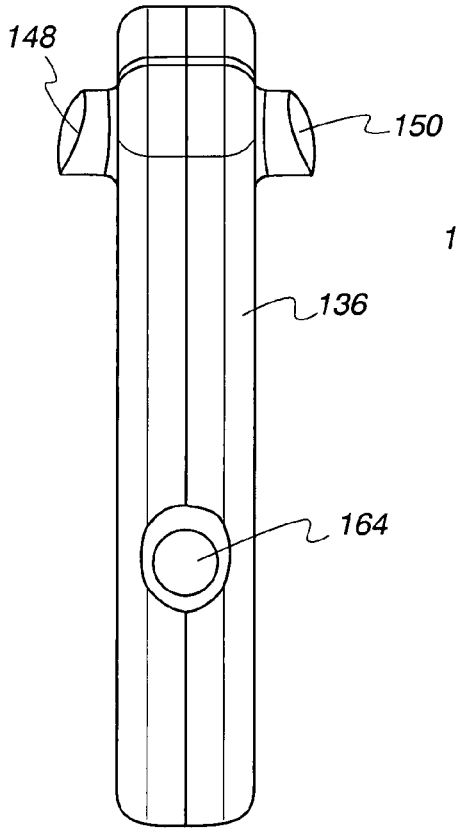
FIG. 27 is an enlarged, side, elevation view of the movable component in FIG. 26.
Figure 29:
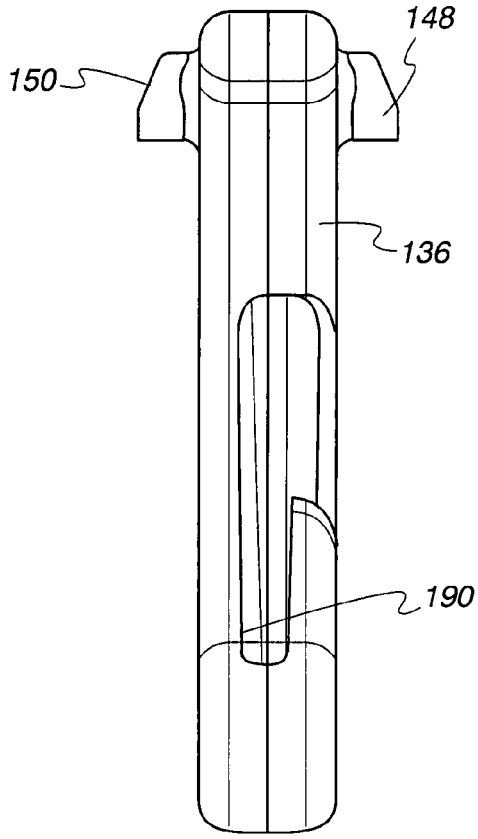
FIG. 29 is an enlarged, elevation view of the movable component from a side opposite that shown in FIG. 27.
Figure 28:
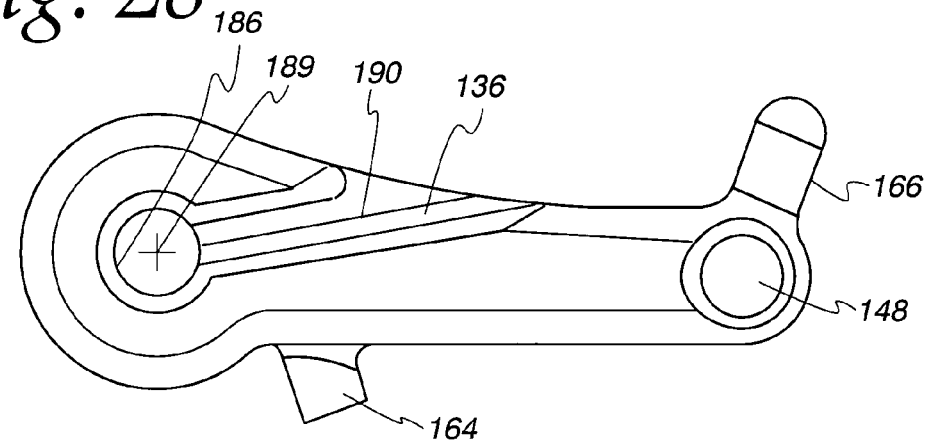
FIG. 28 is an enlarged, front, elevation view of the movable component in FIGS. 26 and 27.

The frame wall 208 may have a receptacle for the end coupling/component 204 that has a configuration identical to that of the end coupling/component 206. Alternatively, as shown in FIGS. 21 and 24, the receptacle may be in the form of an opening 242 that is fully surrounded by the frame wall 208. The receptacle/opening 242 has a smaller effective diameter portion 244 and a larger effective diameter portion 246 bounded by an edge 248. A restricted passage 250 is defined at the juncture between the smaller and larger effective diameter portions 244, 246 of the receptacle/opening 242.

An undercut surface 252 on the end coupling/component 204 cooperatives with the edge 248 in substantially the same manner that the surface 236 on the end coupling/component 206 cooperates within the receptacle 226, as previously described. That is, the surface 252 is radially deformed to be pressed into the smaller effective diameter portion 244 of the receptacle/opening 242 past the restricted passage 250. Through this arrangement, the sheath end 40 is press fit to the frame wall 208 and frictionally, grippingly maintained in a predetermined operating orientation.

The thickness T3 (FIG. 22) of the wall 208 is captively located between axially facing shoulders 254, 256 axially bounding the surface 252. This captive arrangement may be loose, snug, or sufficiently tight that a modicum, or a significant amount, of deformation is required, as with the connection of the end coupling/component 206, thereby necessitating a significant pressing force during the assembly operation. Each of the end couplings/components 204, 206 is preferably made from a deformable material to permit the above assembly operation. The material may be metal or plastic. Of course, the walls 208, 224 might themselves be deformable to make these press-fit connections possible. That is, either or both of the paired cooperating press-fit components might be deformable to facilitate connection with the necessary tenacity that makes the use of separate fasteners unnecessary.

With the above-described structure, assembly of the operating mechanism 16 may be carried out as follows. The flexible cable 28 can be directed through the passageway 134 to be exposed at the end 220 and through the wall opening 138. The end coupling/component 206 can be secured to the mounting plate 210 before or after the preliminary assembly of the mounting plate 210 to the extension plate 124 on the latch system 18. The fastener 216 can be tightened with the mounting plate 210 in the desired orientation once the desired predetermined operating orientation for the sheath end 42 is selected.

The operating portion 36 of the cable core 34 may be pre-assembled to the movable component 136, including press-fitting the sheath end 40 to the frame 142, before directing the cable 28 through the passageway 134. Alternatively, with the end 220 of the tubular element 132 secured, as described above, the cable core 34 can be shifted within the sheath 32 towards the sheath end 40 thereby to facilitate connection of the operating portion 36 of the core 34 to the movable component 136. Once this connection is effected, the frame 142 and actuating element 146 can be press fit to the wall 140 within the opening 138. The operating portion 38 of the cable core 34 can then be connected at the second location 46.

With this construction, each of the sheath ends 40, 42 can be press fit into the predetermined operating orientation relative to the base 26, and more particularly the mounting plate wall 224 and frame wall 208 that are fixed together as part of the base. The operating portions 36, 38 of the cable 28 can be operatively engaged with the operator/trip lever 112 and movable component 136 by simply effecting relative movement therebetween. This obviates the need for separate fasteners on all of the above connections.

It should be noted that the order of steps described above may be changed, as many different combinations of steps are contemplated using the described structure.

To facilitate connection of the tubular element 132 to the movable element 12, an elbow 258 is provided to make up a part of the base 26. The elbow 258 has a reduced diameter end 260 that telescopingly engages the tubular element 132 at the end 262 thereof, opposite the end 220. A fastener 264 can be directed through the elbow 258 and into an internal spring nut 266 to maintain the elbow 258 and tubular element 132 together. The elbow 258 has a flange 268 that can be placed against the movable element 12 and secured by a fastener (not shown) directed into a pre-threaded bore 272.

In the one exemplary form, shown in FIG. 4, the operating mechanism 16 is mounted against an inside surface 274 on the movable element 12 in a manner whereby the latch system 18 can cooperate with the strike element 20 on the strike assembly 22 mounted on the frame support 14.

The foregoing disclosure of specific embodiments is intended to be illustrative of the broad concepts comprehended by the invention.

The invention claimed is:

1. An operating mechanism for a movable closure element to releasably engage a strike assembly on a frame support and thereby releasably maintain a movable closure element on which the operating mechanism is mounted in a predetermined position relative to the frame support, the operating mechanism comprising:

a base comprising a wall extending around a first axis and defining an elongate tubular passageway;

a latch system having: (a) a latched state in which the latch system engages a strike element on the strike assembly so as to maintain a movable closure element on which the operating mechanism is mounted in the predetermined position; and (b) a released state wherein the latch system can be disengaged from a strike element so as to allow a movable closure element on which the operating mechanism is mounted to be moved from the predetermined position; and an actuating system on the base and changeable from a first state into a second state to thereby change the latch system from the latched state into the released state, the actuating system comprising an elongate flexible cable with a length residing at least partially within the passageway and comprising an elongate flexible sheath and a core that is movable guidingly lengthwise relative to the sheath, the cable core having first and second operating portions spaced lengthwise of the cable, the actuating system further comprising an actuating assembly for the elongate flexible cable that is mounted to the wall with the actuating assembly in operative engagement with the base, wherein the first operating portion of the cable core engages the actuating assembly at a first location and the second operating portion of the cable core engages the latch system at a second location, wherein the wall is configured so that the cable cannot be extended in a straight line through the passageway between the first and second locations, the cable core movable relative to the sheath as the actuating system is changed from the first state into the second state to thereby cause the cable core to change the latch system from the latched state into the released state, wherein the sheath has spaced ends and one of the spaced ends is fixed relative to a mounting plate on the base in a predetermined operating orientation.

2. The operating mechanism for a movable closure element according to claim 1 wherein the actuating assembly comprises a frame that is mounted to the wall with the actuating assembly in operative engagement with the base and an actuating element that is movable relative to the frame between a normal position and an actuated position to thereby cause the cable core to move and thereby change the latch system from the latched state into the released state and the one spaced end of the sheath is fixed to the frame in the predetermined operating orientation.

3. The operating mechanism for a movable closure element according to claim 2 wherein there are cooperating components on the one spaced end of the sheath and the frame that cooperate to allow the one spaced end of the sheath to be press fit and frictionally maintained in the predetermined operating orientation.

4. The operating mechanism for a movable closure element according to claim 3 wherein there is an edge on the frame that grippingly engages a surface on the one end of the sheath with the one end of the sheath in the predetermined operating orientation.

5. The operating mechanism for a movable closure element according to claim 4 wherein the edge is defined on a wall on the frame and there are first and second shoulders on the one end of the sheath that face towards each other and between which the frame wall captively resides to at least one of: (a) confine relative shifting of the one end of the sheath and frame wall lengthwise relative to the cable; and (b) maintain the predetermined operating orientation for the one end of the sheath.

6. The operating mechanism for a movable closure element according to claim 5 wherein the frame wall has an opening that is fully surrounded by the frame wall and with a larger effective diameter portion and a smaller effective diameter portion, with the smaller effective diameter portion bounded by the edge such that the one end of the sheath can be directed into the larger effective diameter portion and thereafter moved relative to the wall by being shifted transversely to the length of the cable to cause the edge to grippingly engage the surface of the one end of the sheath and thereby maintain the one end of the sheath in the predetermined operating orientation.

7. The operating mechanism for a movable closure element according to claim 3 wherein there are no separate fasteners required to maintain the one spaced end of the sheath in the predetermined operating orientation.

8. The operating mechanism for a movable closure element according to claim 1 wherein the latch system comprises a housing and an operator that is mounted to the housing for movement between a normal position and actuated positions as an incident of which the latch system is changed between the latched state and the released state and the one spaced end of the sheath is fixed to the housing in the predetermined operating orientation.

9. The operating mechanism for a movable closure element according to claim 8 wherein there are cooperating components on the one spaced end of the sheath and the housing that cooperate to allow the one spaced end of the sheath to be press fit and frictionally maintained in the predetermined operating orientation.

10. The operating mechanism for a movable closure element according to claim 9 wherein there is an edge on the housing that grippingly engages a surface on the one end of the sheath with the one end of the sheath in the predetermined operating orientation.

11. The operating mechanism for a movable closure element according to claim 10 wherein the edge is defined on a wall on the housing and there are first and second shoulders on the one end of the sheath that face towards each other and between which the housing wall captively resides to at least one of: (a) confine relative shifting of the one end of the sheath and housing wall lengthwise relative to the cable; and (b) maintain the predetermined operating orientation for the one end of the sheath.

12. The operating mechanism for a movable closure element according to claim 11 wherein the mounting plate is maintainable selectively in a plurality of different fixed positions relative to the housing base thereby to select different predetermined operating orientations for the one end of the sheath.

13. The operating mechanism for a movable closure element according to claim 8 wherein the operator has a wall with a first surface and a slot, the cable core has an enlarged fitting at one of the spaced operating portions and the one of the spaced operating portions can be operatively engaged with the operator by moving the cable core into the slot in a direction transverse to the length of the slot to place the enlarged fitting in confronting relationship with the first surface, the enlarged fitting bearing against the first surface and thereby causing the operator to change from its normal position into its actuated position as an incident of the actuating system being changed from its first state into its second state.

14. The operating mechanism for a movable closure element according to claim 1 wherein the latch system has a housing that is fixed relative to the base and the base comprises a tubular element that defines the elongate tubular passageway and the tubular element has a bent configuration.

15. The operating mechanism for a movable closure element according to claim 14 wherein the base comprises a support that extends into the tubular element and has a mounting flange to be placed against a movable closure element to which the operating mechanism is attached.

16. The operating mechanism for a movable closure element according to claim 15 in combination with a movable closure element to which the operating mechanism is attached, the latch system having a housing that is attached to the movable closure element.

17. The operating mechanism for a movable closure element according to claim 1 wherein the actuating assembly comprises a frame that is mounted to the wall with the actuating assembly in operative engagement with the base and an actuating element that is movable relative to the frame between a normal position and an actuated position to thereby cause the cable core to move and thereby change the latch system from the latched state into the released state, the actuating assembly comprising a first component that engages the first operating portion of the cable core in a manner that the first operating portion of the cable core is pivotable relative to the first component about a first axis that is transverse to the length of the cable.

18. The operating mechanism for a movable closure element according to claim 17 wherein the first operating portion of the cable has a straight fitting with a length extending generally parallel to the first axis and guided within a receptacle in the first component.

19. The operating mechanism for a movable closure element according to claim 1 wherein the latch system comprises a housing and at least one rotor that is movable relative to the housing between latched and released positions.

20. The operating mechanism for a movable closure element according to claim 1 in combination with a movable closure element to which the operating mechanism is attached and a frame support having a strike assembly, the movable element mounted for movement between the predetermined position and a second position, the latch system engaging the strike assembly with the movable element in the predetermined position and the latch assembly in the latched state.

21. The operating mechanism for a movable closure element according to claim 1 wherein the other of the spaced ends of the sheath is fixed to the base in a predetermined operating orientation.

22. The operating mechanism for a movable closure element according to claim 1 wherein the one of the spaced ends has a coupling with a straight length that guides the core in a straight path.

* * * * *

UNITED STATES PATENT AND TRADEMARK OFFICE

CERTIFICATE OF CORRECTION

PATENT NO. : 8,011,699 B2
APPLICATION NO. : 11/906966
DATED : September 6, 2011
INVENTOR(S) : Christopher M. Lane It is certified that error appears in the above-identified patent and that said Letters Patent is hereby corrected as shown below:

Cols. 14-15, lines 65-3; Claim 12 should read as follows:

12. The operating mechanism for a movable closure element according to claim 11 wherein the mounting plate is maintainable selectively in a plurality of different fixed positions relative to the base thereby to select different predetermined operating orientations for the one end of the sheath.

Signed and Sealed this
Twenty-second Day of November, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,011,699 B2
APPLICATION NO. : 11/906966
DATED : September 6, 2011
INVENTOR(S) : Christopher M. Lane It is certified that error appears in the above-identified patent and that said Letters Patent is hereby corrected as shown below:

Title Page, please insert;

-- (73) Assignee: Tri/Mark Corporation, New Hampton, IA (US) --

Signed and Sealed this
Second Day of October, 2012

David J. Kappos

David J. Kappos
*Director of the United States Patent and Trademark Office*